United States Patent [19]

Taylor

[11] Patent Number: 5,022,473

[45] **Date of Patent: * Jun. 11, 1991**

[54] ADJUSTABLE FISHING JAR

[76] Inventor: William T. Taylor, c/o Razorback Oil Tools, P.O. Box 267, Houma, La. 70361-0267

[ * ] Notice: The portion of the term of this patent subsequent to Apr. 24, 2007 has been disclaimed.

[21] Appl. No.: 374,752

[22] Filed: Jul. 3, 1989

Related U.S. Application Data

[63] Continuation-in-part of Ser. No. 299,227, Jan. 23, 1989, Pat. No. 4,919,219.

[51] Int. Cl.[5] ..... E21B 31/107

[52] U.S. Cl. ..... 175/299; 166/178; 175/302; 175/304

[58] Field of Search ..... 175/302, 303, 304, 300, 175/299; 166/178

[56] References Cited

U.S. PATENT DOCUMENTS

| | | | |
|---|---|---|---|
| 3,685,598 | 8/1972 | Nutter | 175/302 |
| 3,880,249 | 4/1975 | Anderson | 175/302 |
| 4,036,312 | 7/1977 | Deluish | 175/302 |
| 4,333,542 | 6/1982 | Taylor | 175/299 |
| 4,553,614 | 11/1985 | Jürgens et al. | 175/302 |
| 4,662,460 | 5/1987 | Loeb et al. | 175/305 |
| 4,694,917 | 9/1987 | Heidemann et al. | 175/299 |

*Primary Examiner*—Hoang C. Dang

*Attorney, Agent, or Firm*—Matthews & Associates

[57] ABSTRACT

A jar tool for inclusion into a well fishing operating string which provides resilient tensional stretch to operate the tool. The tool is adapted to compress an upper release spring to store energy corresponding to tensional force in the operating string force. A release latching lug array connects the spring to a central mandrel having an impact hammer. The tool housing forms an impact anvil. The spring is compressed to a designated compressional force by the distance that the latch lug array is moved in an adjustable latch release sleeve before suddenly releasing the spring from the mandrel. The tension in the operating string then pulls the mandrel hammer into jarring impact with the housing anvil. Provision is made for designating this pre-release movement of the latching lug array and also provides apparatus for adjusting the distance of the pre-release movement and thereby the compressional force imparted into the spring.

12 Claims, 3 Drawing Sheets

ADJUSTABLE FISHING JAR

This application is a Continuation-In-Part of application Ser. No. 299,227, filed Jan. 23, 1989, now the U.S. Pat. No. 4,919,219.

BACKGROUND OF THE INVENTION

This invention generally relates to downhole well jarring apparatus as utilized in the drilling and related operations for oil and gas wells. More specifically, the invention pertains to an advance in well jars of the mechanical type as exemplified by the tools disclosed in the prior art.

Well jar apparatus is generally provided of the mechanical type as herein disclosed and of the hydraulic type as well.

The principal disadvantage of the hydraulic type well jars is that they become overheated with continuous use and become either ineffective or inoperative due to the heat. On the other hand, most of the mechanical type jars are difficult to field adjust, if adjustable, to provide a designated jar impact force. Also, the latching or triggering mechanisms in mechanical jars, such as spherical balls for example, are subject to very rigorous wear and deformation forces. Such forces limit the useful term of these mechanical jars until rebuild or replacement.

The presently known prior art are the following: Beck U.S. Pat. No. 1,989,906, Philips U.S. Pat. No. 2,122,751, Kennedy et al U.S. Pat. No. 2,166,299, Howard U.S. Pat. No. 2,634,102, Andrews U.S. Pat No. 2,882,018, Anderson U.S. Pat No. 3,880,249, and Taylor U.S. Pat. No. 4,333,542.

OBJECTS OF THE INVENTION

An important object of the present invention is to provide a well jar which can be adjusted easily to produce a designated and repeatable impact force.

Another object of the invention is to provide a latching mechanism within the well jar which can latch and contain a large compressive force which is released hundreds of times without undue wear or parts deformation;

Another object of the present invention is to provide a well jar which will operate compatibly with conventional fishing tools and jar accelerators.

SUMMARY OF INVENTION

The foregoing and other objects and advantages of the invention are provided in an adjustable fishing jar apparatus having an operating mandrel reciprocatively mounted within a housing body with the mandrel and the body being adapted to be connected into a fishing operating string. The mandrel and the body form an impact hammer and an impact anvil for creating an upwardly directed impact force. An impact release spring is adapted to be compressed between the mandrel and the body responsive to tension applied to the mandrel.

At least one releasable lug array latching mechanism is connected between the mandrel and an adjustable loading adjustment sleeve for compressing the release spring a designated distance. The lug array or arrays are released when moved past a release position established by the loading adjustment sleeve. The sudden release of the impact release spring translates to sudden upward movement of the mandrel and causes impact of the hammer with the anvil responsive to the tensional force in the operating string. The loading adjustment sleeve is adjustably threaded into the housing body for easy rotation to cause designated changes in compressional force in the release spring proportionate to changes in the longitudinal position of the adjustment sleeve. The adjustment sleeve forms external grooves or serrations exposed to an opening in the body to permit a hand tool to rotate the adjustment sleeve conveniently.

A relatching spring device is included to return the latching lug array back to a relatch position. Each releasable lug array may be a generally toriodal body including many lug segments providing substantially a full circle of compressional area of support between circumferential areas provided by the mandrel and by the loading adjustment sleeve to latch the compression spring during compression. The lug segments are continuously confined longitudinally by an upper spring loading sleeve disposed in compression between the lug segments and the release spring and a lower relatching sleeve disposed between the latching lugs and the relatching spring.

In alternate embodiments, two or more latching lug sector arrays are provided. Each sector array utilizes a few arcuate lug sectors which extend through windows in the mandrel. Both lug sector arrays are released and relatched at the same time.

It is noted that a preferred embodiment is illustrated in FIGS. 1A, 1B, 2A, 3A, 4A, 5, 6A, 7A, 8A and 9. An alternate embodiment (to the extent differing from the preferred embodiment) is illustrated in FIGS. 2B, 3B, 4B, 6B, 7B, 8B, 10B and 11B.

DESCRIPTION OF A PREFERRED EMBODIMENT

Figures 1A, 1B, 2A:
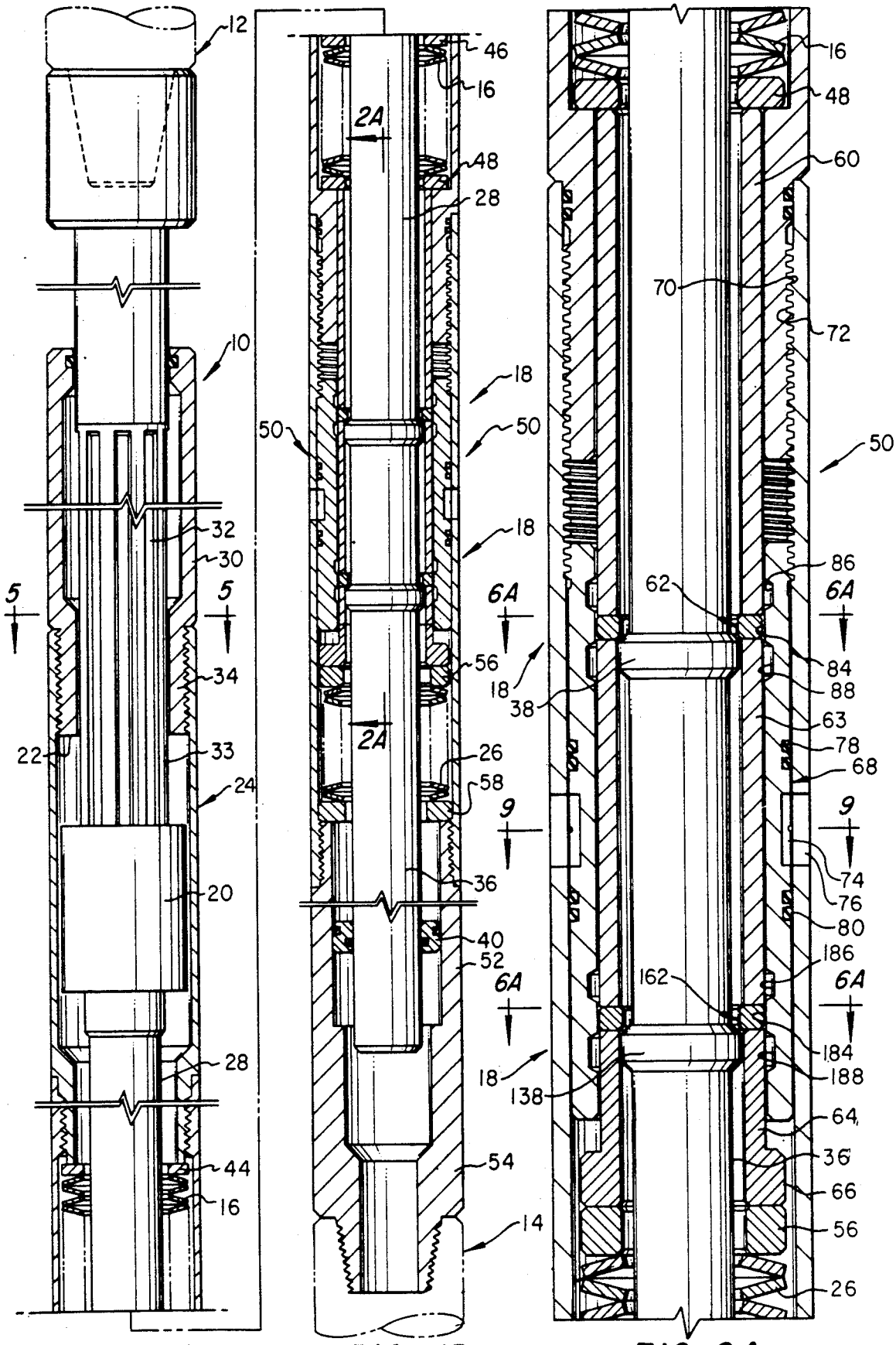
FIGS. 1A and 1B constitute a partly schematic, longitudinal cross section of the full length of the jar tool with its central operating mandrel being illustrated in elevation.
FIG. 2A is an enlarged longitudinal cross section of the tool taken between the arrows 2A—2A of FIG. 1B.

As an initial general description of the jar tool 10 as shown in FIGS. 1A and 1B, the jar tool can be manufactured in several sizes. For example, the tool 10 may be provided from $1\frac{7}{8}$" OD to 3" OD, or greater for operation from a wire line as the operating string. These sizes can readily be adapted to carry electrical conductors as needed. With well tubing or drillpipe as the operating string, the tool 10 can be provided in several sizes ranging from $1\frac{7}{8}$" OD to 9" OD, as examples.

The tool 10 as shown is connected into an upper operating string 12 and to apparatus 14 below which constitutes the "fish" or apparatus to be pulled up from a possibly stuck or lodged position in the well bore.

The tool 10 tends to extend in length responsive to tensional force applied to the operating string 12 from the earth's surface. The operating string may also include a jar accelerator (not shown) which provides additional resilient stress and stretch to the operating string responsive to tensional force. The operating string as a whole also stretches along its length.

While the tool 10 is being extended in length by a tensional force, an upper impact release spring 16 is compressed accordingly and stores energy corresponding to the operating string stretch force. A releasing latching lug device 18 connects the release spring 16 to a central mandrel 28 which extends out of housing 24 as the spring 16 is compressed.

An impact hammer 20 is connected to the mandrel 28 and adapted to strike an anvil 22 formed with housing 24 (when the latch lug assembly 18 suddenly releases the spring 16 from compression).

The tensional force placed in the operating string 12 to overcome the compressional force in release spring 16 is suddenly applied to very rapidly pull the mandrel 28 and attached hammer 20 into impact with the anvil 22 to create an upwardly jarring impact force by the tool 10 to the fish 14.

The latching lug device 18 is recocked by recocking spring 26 as the operating string 12 is lowered to lower the mandrel 28 into a relatched position with the latch lug device 18.

The release spring 16 is compressed to a designated compressional force by the distance that the latch lug is moved before releasing the spring 16. The present invention provides for designating this pre-release movement of latching lug 18 and also provides adjustable apparatus for adjusting the distance of the pre-release movement and thereby the compressional force imparted into release spring 16.

Depending on the size of the jar tool 10 and the travel distance of the hammer 20 into impact with anvil 22, the impact force of the hammer against the anvil may be in the range of 4.1 to 4.3 times the compressive force released from spring 16. Thus, a compressive force of 500 lbs. in the spring 16 will cause an impact force of 2100 lbs of impact force, for example. In the $3\frac{5}{8}$" OD size, for example, a compressive force of 3300 lbs. will result in an impact force of roughly 14,000 lbs.

Figure 5:
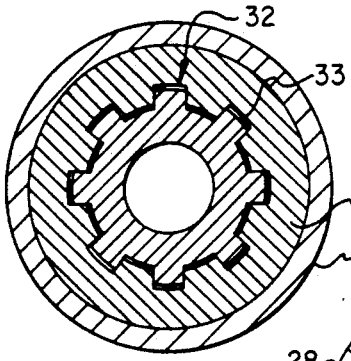
FIG. 5 is a lateral cross section of the tool taken at line 5—5 of FIG. 1A.

The jar tool 10 is seen to include an upper connection sub 30 adapted for connection to the operating string 12 and connected to the spline section 32 of the mandrel 28. The spline section 32 connects through splines 33 into spline sub 34 as shown in FIGS. 1A and 5.

The spline section 32 also connects with the hammer 20 carried by the mandrel 28. The sub 34 and anvil 22 are connected to form a part of the body 24. The lower mandrel 36 is connected as part of the overall mandrel 28 to the hammer 20 and extends down through the tool 10. The lower mandrel 36 carries a beveled latch lug land 38 (and 138 when provided). At the lower end of mandrel 36 is shown a lower floating liquid seal 40 disposed between the mandrel 36 and a body seal housing 52.

The release spring 16 is seen to be composed of a plurality of Bellville springs disposed in precompression between an upper impact spring seat 44 and a lower spring seat 48. Disposed near the center of the spring 16 is an intermediate impact spring guide 46 as shown. The latch release mechanism 18, as best shown in FIGS. 2A and 2B, is housed in a body spring and latch section 50 of the body 24.

A lower connection sub 54 of the body 24 is adapted for connection into a fish section 14 as previously mentioned.

It is of note that the tool 10 is adapted to be filled with a liquid which is provided primarily to keep the inner parts of the tool 24 free of dirt and debris. The tool 10 does not depend on hydraulic fluid for operation but is benefited by the fluid which serves as a lubricant and an isolation fluid. It is to be noted that the fluid within the tool 10 remains at a pressure equal to the pressure in the well bore by virtue of the floating piston 40 found in the lower section 52. The "0" ring seals in section 34 and the floating piston 40 as shown are conventional and are not described further herein.

Figure 2B:
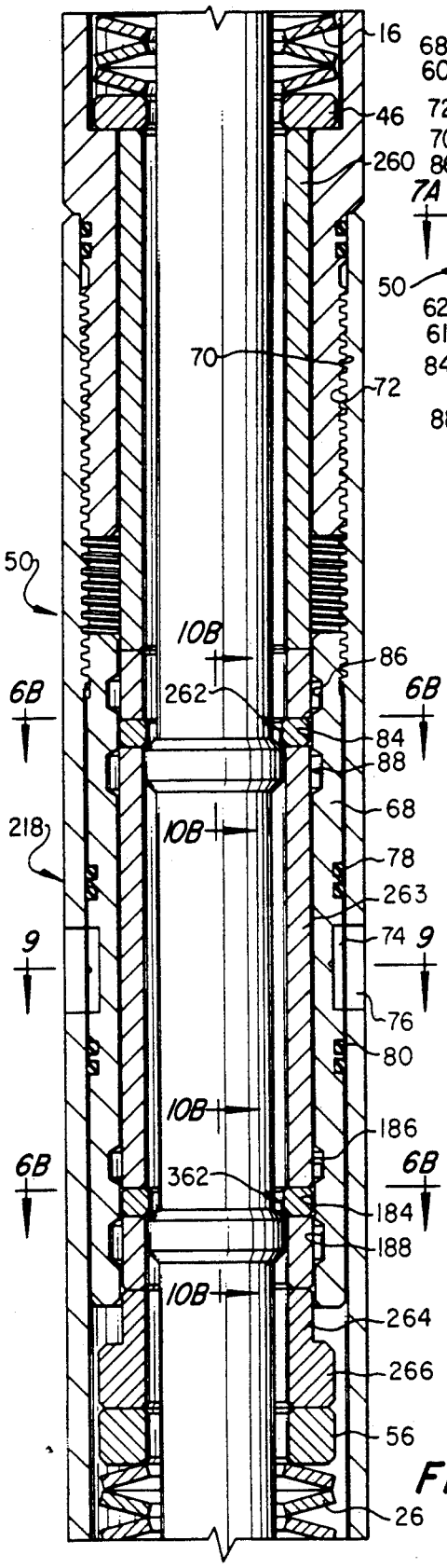
FIG. 2B is an enlarged cross section of apparatus alternate to FIG. 2A.

A recocking spring 26, also composed of Bellville springs as shown, is supported at its upper end by a reset and adjustment seat 56 and a lower reset spring seat 58 as best shown in FIGS. 1B, 2A and 2B.

The prefix "1", as used with the numerals in FIG. 2A, is to identify the second element of duplicate elements.

EMBODIMENT OF FIG. 2A

The structure of the latching lug arrangement 18 is shown in both FIGS. 1B and 2A. The description is best followed with reference to FIG. 2A. As shown in FIG. 2A, the latching arrangement 18 is housed in the body section 50 of the body 24 and extends from the upper spring 16 to the recocking spring 26.

As shown, annular lug arrays 62 and 162 are longitudinally confined by an upper loading sleeve 60 extending between the lug array 62 and the spring seat 48 of release spring 16. Below the lug array 62 is a center loading sleeve 63 between the lug array 62 and a lower lug array 162. Below the lower lug array 162 is the reset seat 56 of the recocking spring 26. The latch lugs 61 and 161 (best shown in FIG. 6A) are gripped through the upper loading sleeve 60, the center loading sleeve 63, and the lower loading sleeve 64 by the compressional force of the release spring 16 and the recocking spring 26. As shown, the lower loading sleeve 64 is provided with a radial offset or flange 66 in order to directly contact the recocking reset spring seat 56.

It is to be noted that the springs 26 and 16, acting through the spring seat 56 and the spring seat 48, maintain the lug arrays 62 and 162 in centered position on beveled latch lug lands 84 and 184. The latch lug lands 38 and 138 on the mandrel 36 are located immediately below the lug arrays 62 and 162 as shown in FIG. 2A and this position is the cocked position.

It is to be noted that the loading adjustment sleeve 68 is in threaded connection with the housing body 50 through complementary threads 70 and 72. As the adjustment sleeve 68 is further threaded upwardly in the body 50, there is a further distance for the latch lug arrays 62 and 162 to travel before reaching the beveled latch lug grooves 86 and 186. It is also noted that adjustment sleeve 68 is free to be rotated in the threads 70 and 72 without restriction by the springs 16 or 26.

As mandrel 36 and latch lands 38 and 138 are pulled in tension upwardly, the lands 38 and 138 engage the lower beveled sides of the latch lug arrays 62 and 162. Movement of the operating string 12 and the central mandrel 28 and mandrel section 36 moves the latching lands 38 and 138 into forceful contact with the latch lug arrays 62 and 162 and translates the upward movement through the latch arrays 62 and 162, the upper loading sleeve 60, and the spring guide seat 48 to compress the spring 16. The deflection of spring 16 during its compression requires a designated force for each increment of deflection.

At such time as sufficient compression has been applied through the latch arrays 62 and 162 as described, the lugs 61 and 161 reach the bevels between the latch lands 84 and 184 and the grooves 86 and 186. When the latch lugs reach the lug grooves 86 and 186, the lugs 61 and 161 suddenly expand into the lug grooves and permit the latch lands 38 and 138 to substantially instantaneously move upwardly in response to the tensional force imposed by the operating string 12 and to carry the hammer 20 into forceful impact against the anvil 22 and to the fish 14 through the body 24.

As now described, the adjustment sleeve 68 is seen to have a thread 70 threadedly connected into a housing thread 72 such that rotation of the sleeve 68 will move it upwardly or downwardly, depending on the direction of rotation. The adjustment sleeve 68 forms latch lug release grooves 86 and 186, latch lug lands 84 and 184, and reset lug grooves 88 and 188 as shown. In cocked position, the latch lug arrays 62 and 162 are carried on the latch lug lands 84 and 184 and held in the same position by the spring 16 and reset spring 26 acting through the loading sleeves 60, 63 and 64.

The latch lug lands 38 and 138 of the mandrel section 36 are below the latch lug arrays 62 and 162 when the tool 10 is in a "cocked" position. Upward movement of the latch lands 38 and 138 moves the latch arrays 62 and 162 to compress the release spring 16 until such time as the latch arrays 62 and 162 suddenly expand into the latch lug grooves 86 and 186 and thereby release the mandrel section 36 for upward travel in response to the tension applied in the operating string 12.

The compressional stress in release spring 16, when suddenly released, immediately expands the spring to bring the spring guide seat 48 down into contact with its support shoulder. Concurrently, the upward support sleeves 60 and 63 brings the lugs 61 and 161 down, back on the latch lands 84 and 184 to return the assembly to the condition shown in FIG. 4A. Further downward push of latch land lug 38 pushes the lug 61 of the lug array 62 into groove 88 for consequent return to land 84.

FIGS. 5, 6A, 7A, and 8A, it is evident that the mandrel assembly 28 is all in splined relation to the housing 24 and thereby to the fish string 14. Consequently, all the parts shown in FIG. 2A remain in splined and non-rotating position with respect to the mandrel section 36 and the housing section 50 with exception of the loading adjustment sleeve 68 as described.

Figure 3A:
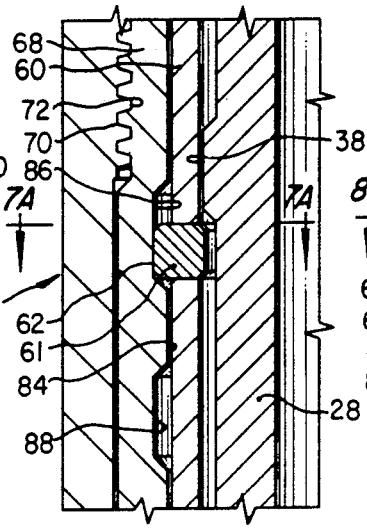
FIG. 3A shows a segment of FIG. 2A showing parts of the jar tool at a designated instant during the operation of the jar tool.
Figure 6A:
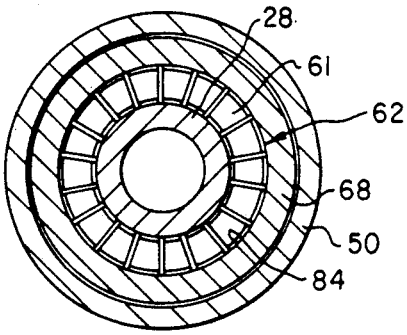
FIG. 6A is a lateral cross section of the jar tool taken at lines 6A—6A of FIG. 2A.
Figure 7A:
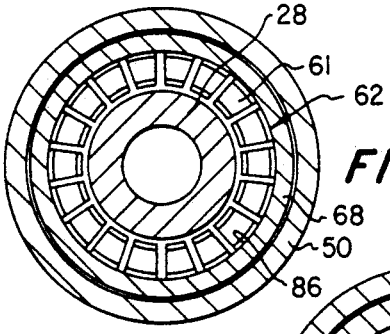
FIG. 7A is a lateral cross section of the tool taken at line 7A—7A of FIG. 3A.
Figure 8A:
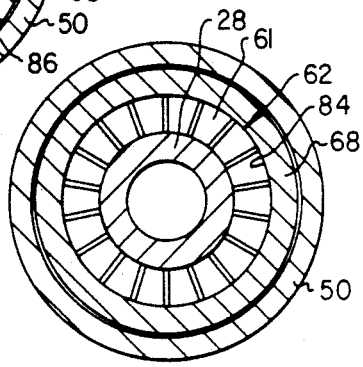
FIG. 8A is a lateral cross section of the tool taken at line 8A—8A of the FIG. 4A.

The section of FIG. 6A illustrates the lug arrays 62 (and 162) in centered positions on the latch lug lands 84 and 184 of the adjustment sleeve 68 before firing. FIG. 7A shows the latch lug arrays 62 and 162 expanded into the latch lug grooves 86 and 186 as shown in FIG. 3A during firing. FIG. 3A shows the lugs 61 and 161 (or the arrays 62 and 162) again centered into the reset lug grooves 86 and 186 prior to the reset procedure described with reference to FIG. 4A.

It is to be noted that only one lug array 62 with its, corresponding mandrel lug 38 and corresponding grooves 86 and 88 are likely to be used in the very small tools since multiple lug arrays are not needed for the smaller loading involved.

Figure 9:
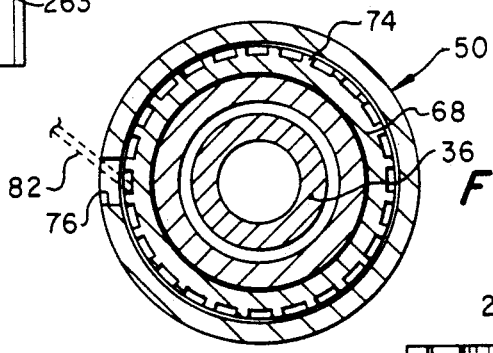
FIG. 9 is a cross sectional view showing an adjustment sleeve and a body adjustment port taken at line 9—9 of FIGS. 2A and 2B.
Figure 11B:
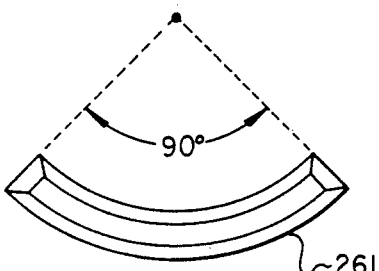
FIG. 11 is a top view of a typical lug sector as mounted in FIGS. 6B, 7B and 8B.
Figure 10B:
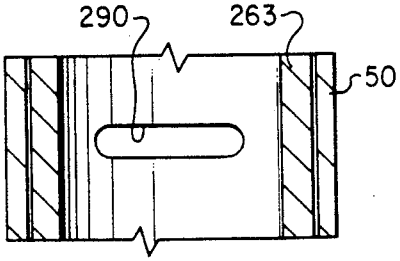
FIG. 10B is an elevational cross sectional view showing one of the lug windows in the loading sleeve as seen from lines 10B—10B of FIG. 2B.

The compressive force imposed in release spring 16 by its compressive displacement (by spring guide seat 48 and upper loading sleeve 60 from the latch lug array 62) is varied by threaded adjustment of the adjustment sleeve 68 through its threads 70 along the housing thread 72. As seen in FIGS. 6A and 9 the further that adjustment sleeve 68 is threaded upwardly in the housing 50, the further the lug arrays 62 and 162 must travel in order to move off the latch lug lands 84 and 184 and escape outwardly into the latch lug grooves 86 and 186.

This upwardly (or downwardly) movement of the adjustment sleeve 68 is accomplished by rotation of the sleeve. Sleeve 68 is formed with vertical serrations or splines 74 which are exposed to the exterior of housing 50 through a port 76. The "0" ring seals 78 and 80 seal the interior of the tool from fluid as may become present in the port 76.

As shown in FIG. 9, a hand tool 82 may be provided to engage the serrations 74 through the access port 76 and thereby rotate the sleeve 68 in small increments. A port plug (not shown) may be used to close off port 76 between rotational adjustments of sleeve 68. Also, a set screw (not shown) may be provided to lock sleeve 68 against further rotation after adjustment.

It is to be noted that sleeve 68, when in the "cocked" position shown in FIG. 2A, has no longitudinal force, or friction, as might be imposed by springs 16 or springs 26. Accordingly, the sleeve 68 is readily rotated for adjustment.

The thread pitch of threads 70 and 72 are calibrated with respect to the position of release lands 84 and 184 such that the increments of rotation of the adjustment sleeve 68 will result in corresponding designated increments of compressive force applied to the release spring 16. This compressive force will be suddenly released when the latch arrays 62 and 162 expand into the latch lug grooves 86 and 186.

The pitch of the threads 70 and 72 may be of a pitch of from four turns per inch to ten turns per inch, for example. The pitch of the threads 70, the compressive rate of the release springs 16 and the distance traveled by the latch lugs 61 and 161 across lands 84 and 184 to trigger the latch arrays 62 and 162 are all designated by one skilled in the art.

OPERATION OF THE EMBODIMENT OF FIG. 2A

Referring now to FIGS. 2A–4A, the tool 10 is shown in cocked position in FIG. 2A for delivering a jarring or impact force to a fish 14 in response to tensional force applied through the operating string 12. The hammer 20 is moved a maximum distance down from anvil 22.

As tensional force is applied to the operating string 12, the mandrel 28 and mandrel, section 36 are pulled upwardly until the latch lug lands 38 and 138 are in forceful contact with the latch lug arrays 62 and 162. As further tension is applied by the string 12, the latching arrays 62 and 162 are moved upwardly by the latch lug lands 38 and 138 and the lug arrays 62 and 162 begin to move off the latch lug lands 84 and 184. The compression of the release spring 16 corresponds to the total movement of the connected lug array 62 and 162, upper loading sleeve 60, and impact spring guide 48.

At such time as the lug arrays 62 and 162 move off of the latch lug lands 84 and 184, they virtually instantaneously travel down the bevel of the lug grooves 84 and 184 and consequently permit the individual lugs 61 and 161 of the lug arrays 62 and 162 to move outwardly into the lug grooves 86 and 186. Such movement increases the internal clearance of the lug arrays 62 and 162 and permits the almost instantaneous travel of the lugs 61 and 161 to move outwardly. FIG. 3A shows the relative position of the parts almost instantaneously after the lug array 62 has expanded into the lug groove 86 to permit the lug lands 38 and 138 virtually instantaneous release.

When suddenly relieved of the force imposed by the release spring 16, the mandrel 28 is instantaneously responsive to be moved by the tensional force applied to the operating string 12. This tensional force pulls the hammer 20 upwardly at high velocity to impact the anvil 22 and transmit this impact loading into an upward impact or jar of the tool 1() to the fish 14.

The pre-release force provided by the release spring 16 is, of course, in proportion to the distance traveled by the lug arrays 62 and 162 along the lug lands 84 and 184 before release of the lugs 61 and 161.

It is seen that the compression movement of the impact release spring 16 is small when it is compressed by upward movement of the mandrel 28 as translated through the latch lug land 38, the latch array 62 and the loading sleeve 60. The latch lug 61 may move, for example one inch, before the lug array 62 expands into the groove 86 to release the mandrel 28 and the spring 16. The tension in mandrel 28 required to trip the latch assembly 18 has caused the operating string 12 to stretch several inches. The tensional stretch of the string 12 causes the hammer 20 to move at high velocity for several inches before it strikes the anvil 22.

As previously mentioned, the impact force of the hammer 20 against the anvil 22 may be designated variously. It has been found empirically that the impact force of the hammer against the anvil may be in the range of 4.1 to 4.3 times the force released by the release spring 16. Thus, a compressive force of 500 lbs. in the release spring 16 will cause an impact force of 2100 lbs. of impact force, for example. In the 3⅝" OD size, for example, a compressive force of 3300 lbs. in release spring 16 will result in an impact force of roughly 14000 lbs. by hammer 20 against the anvil 22 of the body 24.

Figure 4A:
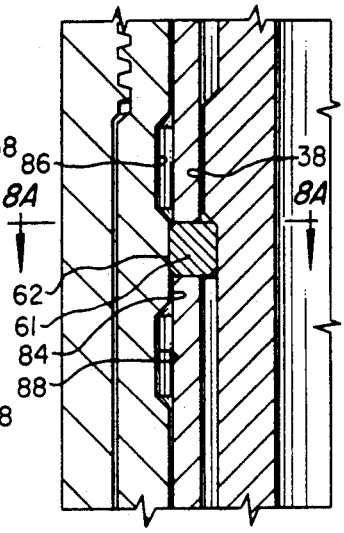
FIG. 4A is the same segment as shown in FIG. 3A at another designated instant during the operation of the jar tool.

To recock the jar tool 10, the mandrel 28, including the mandrel section 36 and the latch lands 38 and 138, are moved downwardly. As shown in FIG. 4A, the springs 16 and 26 have almost instantaneously repositioned and centered the lug arrays 62 and 162 on the lug lands 84 and 184. As the mandrel section 36 and the latch lug lands 38 and 138 are moved downwardly, the movement forces the land lug arrays 62 and 162 also downwardly until the lugs 61 and 161 of the arrays are moved off of the lug lands 84 and 184 into the reset lug grooves 88 and 188.

When the lugs 61 and 161 are allowed to expand into the lug grooves 88 and 188, the latch lands 38 and 138 move on past the lug arrays 62 and 162, and the reset spring 26 immediately snaps the lug arrays 62 and 162 back into the cocked positions on the lug lands 84 and 184 as shown in FIG. 2A. The line 8A—8A of FIG. 4A shows the position of the lug arrays 62 and 162 as shown in corresponding FIG. 8A. The recocked position of lug array 62 and 162 are, of course, again shown in FIG. 6A.

EMBODIMENT OF FIG. 2B:

The structure of the alternate latching lug arrangement 218 is shown in FIG. 2B and the description is best followed with reference to FIG. 2B, 3B, 4B, 6B, 7B, 8B, 10 and 11. As shown arrangement 218 is housed in the body section 50 of the body 24 and from the upper spring 16 to the recocking spring 26. The prefix "2" identifies the elements alternate to similar elements of FIG. 2A. The prefix "3" is used to identify a second element identical to an element identified with a "2" prefix.

As shown, the upper sector lug array 262 and the lower sector lug array 362 are longitudinally confined in windows 290 of a carrier sleeve 263 between an upper loading sleeve 260 extending between the lug array 262 and the lower loading sleeve 264. The lower loading sleeve 264 is located between the sleeve 263 and the reset seat 56 of the recocking spring 26. The individual upper and lower lug sectors 261 and 361 and the windows 290 are best shown in FIGS. 10 and 11. As shown, the lower loading sleeve 264 is formed with a radial offset 266 in order to directly contact the recocking spring reset seat 56.

It is to be noted that the springs 26 and 16, acting through the offset 56 and the spring seat 48, maintain the upper and lower lug sectors 261 and 361 in centered position on the beveled latch lug lands 84 and 184. The latch lug lands 38 and 138 on the mandrel 36 are located immediately below the lug arrays 262 and 362 as shown in FIG. 2B and this is in the "cocked" position.

It is to be noted that the loading adjustment sleeve 68 is in threaded connection with the housing body 50 through corresponding threads 70 and 72. It is to be seen that the further the adjustment sleeve 68 is threaded upwardly in the body 50, there is a further distance for the latch lug sectors 261 and 361 to travel before reaching the beveled latch lug grooves 86 and 186.

As mandrel 36 and latch lands 38 and 138 are pulled in tension upwardly, the lands are engaged with the lower beveled sides of the latch lug sectors 261 and 361. Movement of the operating string 12 and the central mandrel 28 and mandrel section 36 moves the latching lands 38 and 138 into forceful contact with the latch lug sectors 261, and 361, and translates the upward movement through the latch sectors, the upper loading sleeve 260, and the spring guide 48 to compress the spring 16. The deflection of spring 16 during its compression requires a designated force for each increment of compression.

At such time as sufficient compression has been applied through the latch sectors 261 and 361, as described, the lugs 261 and 361 reach the bevels between the latch lands 84 and 184 and the grooves 86 and 186. When the latch lugs 261 and 361 reach the lug grooves 86 and 186, the lugs 261 and 361 suddenly expand into the lug grooves and permit the latch lands 38 and 138 to substantially instantaneously move upwardly in response to the tensional force imposed by the operating string 12 to carry the hammer 20 into forceful impact against the anvil 22 to the fish 14 through the body 24.

As now, described, the adjustment sleeve 68 is seen to have the thread 70 threadedly connected into the housing thread 72 such that rotation of the sleeve 68 will move it upwardly or downwardly, depending on the direction of rotation as previously described.

As also previously described, the compressional stress in release spring 16, when suddenly released, immediately expands the spring to bring the spring guide 48 down into contact with its support shoulder. Concurrently, the upward support sleeve 260 brings the lugs 261 and 361 down and back onto the latch lands 84 and 184 to be returned to the condition shown in FIG. 6B.

Figure 3B:
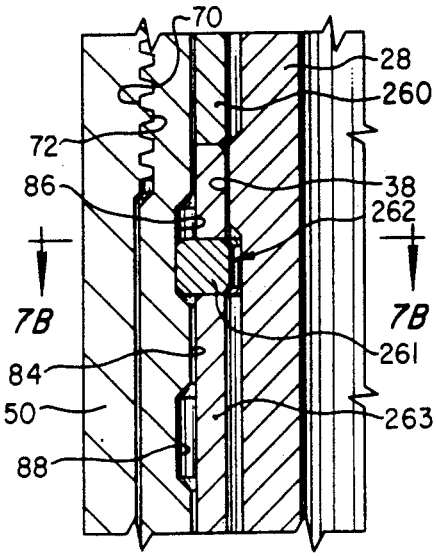
FIG. 3B shows an alternate segment of FIG. 2B.
Figure 6B:
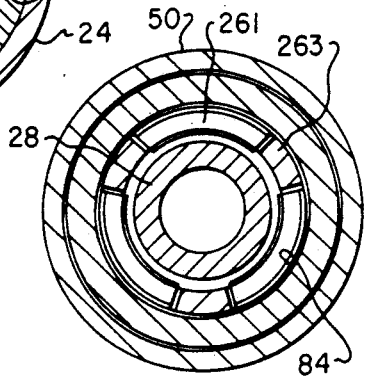
FIG. 6B is an alternate section taken at lines 6B—6B of FIG. 2B.
Figure 4B:
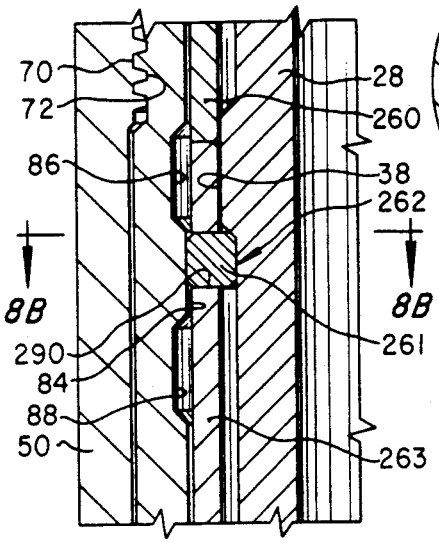
FIG. 4B is an alternate segment as shown in FIG. 3B.
Figure 7B:
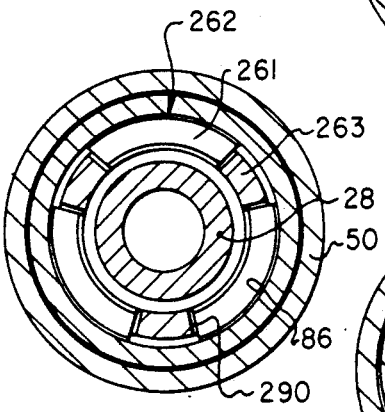
FIG. 7B is an alternate section taken at 7B—7B of FIG. 3B.
Figure 8B:
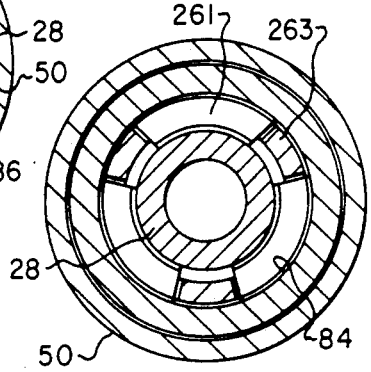
FIG. 8B is an alternate section taken at line 8B—8B of FIG. 4B.

The section of FIG. 6B illustrates the lug sectors 261 and 361 in their centered position on the latch lug lands 84 and 184 of the adjustment sleeve 68 before firing. FIG. 7B shows the latch lug, sectors 261 and 361 expanded into the latch lug grooves 86 and 186 as shown in FIG. 3B during firing. FIG. 8B shows the lugs sectors 261 and 361 again centered onto the reset lug lands 84 and 184 prior to the reset procedure described with reference to FIG. 4B.

The compressive force imposed in release spring 16 by its compressive displacement (by spring guide 48 and upper loading sleeve 260 from the latch lug sectors 261 and 361) is varied by threaded adjustment of the adjustment sleeve 68 through its threads 70 into the housing thread 72. As seen, the further that the adjustment sleeve 68 is threaded upwardly in the housing 50, the further the lug sectors 261 and 361 must travel in order to move off the latch lug lands 84 and 184 and escape outwardly into the latch lug grooves 86 and 186.

This upwardly (or downwardly) movement of the adjustment sleeve 68 is accomplished through rotation of the sleeve 68. Sleeve 68 is formed with vertical serrations or splines 74 which are exposed to the exterior of housing 50 through a port 76. The "0" ring seals 78 and 80 seal the interior of the tool from fluid as may become present in the port 76.

As shown in FIG. 9, a hand tool 82 may be provided to engage the serrations 74 through the access port 76 and thereby rotate the sleeve 68 in small increments. A port plug (not shown) may be used to close off port 76 between rotational adjustments of sleeve 68.

It is to be noted that sleeve 68, when in the "cocked" position shown in FIG. 2B, has no longitudinal force, or friction, as might be imposed by springs 16 or springs 26. Accordingly, the sleeve 68 is readily rotated for adjustment.

It will be obvious to those skilled in the art that the embodiment as herein described may be modified or changed and yet remain in the spirit of the invention and the purview of the appended claims.

That being claimed is:

1. An improvement in an impact down hole jar apparatus including (1) an operating mandrel reciprocatively mounted within a housing body; (2) a compression type impact spring mounted in precompression within said body between a fixed impact spring seat and a moveable impact spring seat; (3) a compression type recocking spring mounted in precompression within said body between a fixed recocking spring seat and a freely moveable recocking spring seat; and (4) an adjustable impact release latch means connected between said mandrel and said body and between said moveable impact spring seat sand said moveable recocking spring seat; (5) said adjustable impact release latch means comprising;

(a) a mandrel operating lug formed by said mandrel as a land around said mandrel;

(b) a first lug support sleeve and a second lug support sleeve urged into abutment against said moveable impact spring seat by said recocking spring and moveable rococking spring seat;

(c) latching lug means including a plurality of arcuately shaped and radially moveable latching lugs longitudinally supported between said first lug support sleeve and said second lug support sleeve;

(d) said latching lugs being longitudinally moveable by said mandrel operating lug when radially confined toward said mandrel and being free of said mandrel operating lug when radially extended away from said mandrel;

(e) an impact compression adjustment sleeve threadly connected within said body for unconfined longitudinal movement within said body responsive to unconfined rotational adjustment of said sleeve within said body;

(f) a latching lug land disposed between a first latching release groove and a second latching release groove formed in the inner wall of said adjustment sleeve;

(g) said latching lug land radially confining said latching lug means toward said mandrel when longitudinally positioned to radially abut said latching lug means;

(h) said first latching release groove and said second latching release groove permitting radial expansion of said latching lug means to be free of said mandrel operating lug where said adjustment sleeve is longitudinally positioned to permit radial release of said latching lug means away from said mandrel operating lug;

(i) said mandrel operating lug, said latching lug means, said latching lug land and said compression adjustment sleeve being concentrically disposed together in a common longitudinal location within said housing body;

(j) said mandrel operating lug operating to carry said latching lug means and said first support sleeve to move said moveable impact spring seat and thereby compress said impact spring until said latching lugs are moved off said latching lug land and then to release said first support sleeve and said moveable impact spring seat when said latching lugs are moved into said first release groove, thereby suddenly releasing said impact spring from compression and returning said latching lug means to said latching lug land; and (k) said mandrel operating lug operating further to carry said latching lug means and said moveable support sleeve to move said moveable recocking spring seat and compress said recocking spring until said latching lugs are moved off said latching lug land and then to release said second support sleeve and said moveable recocking seat when said latching lugs are moved into said lower release groove, thereby releasing said recocking spring from compression and returning said latching lug means to said latching lug land and thereby recocking said apparatus.

2. The apparatus of claim 1 wherein said latching lug means comprise numerous arcuate latching lug segments formed into a substantially continuous circle of said latching lug segments supported between said first support sleeve and said second support sleeve.

3. The apparatus of claim 1 wherein said upper support sleeve means and said lower support sleeve means are joined together to form windows for respectively supporting each segment of a plurality of arcuately shaped latching segments.

4. The apparatus of claim 3 wherein said impact latch release latch means comprises a first and a second impact release latch means connected for joint operation in the same apparatus.

5. The apparatus of claim 1 wherein a plurality of serrations are formed around the circumference of said adjustment sleeve means which may be engaged by a hand tool through a port formed in said body to rotate said adjustment sleeve means easily for longitudinal adjustment while said apparatus is completely assembled.

6. The apparatus of claim 1 wherein said impact spring is comprised of Belleville compression springs.

7. The apparatus of claim 1 wherein said recocking spring means has a compression rate sufficient to maintain said upper support sleeve means and said lower support sleeve means in compression through the release and recocking cycle.

8. The apparatus of claim 1 wherein each rotation of said adjustment sleeve means within said body changes the released compressive force of said impact spring by a designated amount.

9. An improvement in an impact down hole jar apparatus including (1) an operating mandrel reciprocatively mounted within a housing body; (2) a compression type impact spring mounted in precompression within said body between a fixed impact spring seat and a moveable impact spring seat; (3) a compression type recocking spring mounted in precompression within said body between a fixed recocking spring seat and a freely moveable recocking spring seat; and (4) an adjustable impact release latch means connected between said mandrel and said body and between said moveable impact spring seat and said moveable recocking spring seat; (5) said adjustable impact release latch means comprising;

(a) a mandrel operating lug formed by said mandrel as a land around said mandrel;

(b) a first lug support sleeve and a second lug support sleeve urged into abutment against said moveable impact spring seat by said recocking spring and moveable recocking spring seat;

(c) latching lug means including a plurality of arcuately shaped and radially moveable latching lugs longitudinally supported between said first lug support sleeve and said second lug support sleeve;

(d) said latching lugs being longitudinally moveable by said mandrel operating lug when radially confined toward said mandrel and being free of said mandrel operating lug when radially extended away from said mandrel;

(e) an impact compression adjustment sleeve threadly connected within said body for unconfined longitudinal movement within said body responsive to unconfined rotational adjustment of said sleeve within said body;

(f) a latching lug land disposed between a first latching release groove and a second latching release groove formed in the inner wall of said adjustment sleeve;

(g) said latching lug land radially confining said latching lug means toward said mandrel when longitudinally positioned to radially abut said latching lug means;

(h) said first latching release groove and said second latching release groove permitting radial expansion of said latching lug means to be free of said mandrel operating lug where said adjustment sleeve is longitudinally positioned to permit radial release of said latching lug means away from said operating lug; and (i) said mandrel operating lug, said latching lug means, said latching lug land and said compression adjustment sleeve being concentrically disposed together in a common longitudinal location within said housing body.

10. The apparatus of claim 9, wherein said latching lug means comprise a plurality of arcuate latching lug segments formed into a substantially continuous circle of said latching lug segments supported between said first support sleeve and said second support sleeve.

11. The apparatus of claim 10, wherein said recocking spring means has a compression rate sufficient to maintain said upper support sleeve means and said lower support sleeve means in compression through the release and recocking cycle.

12. The apparatus of claim 11, wherein each rotation of said adjustment sleeve means within said body changes the released compressive force of said impact spring by a designated amount.

* * * * *